US008662852B2

(12) United States Patent
Bhokardole et al.

(10) Patent No.: US 8,662,852 B2
(45) Date of Patent: Mar. 4, 2014

(54) SWING AXIAL-ENTRY FOR CLOSURE BUCKET USED FOR TANGENTIAL ROW IN STEAM TURBINE

(75) Inventors: Prashant Bhokardole, Karnataka (IN); Prasad Mishrikotkar, Maharashtra (IN)

(73) Assignee: General Electric Company, Schenectady, NY (US)

( * ) Notice: Subject to any disclaimer, the term of this patent is extended or adjusted under 35 U.S.C. 154(b) by 701 days.

(21) Appl. No.: 12/909,376

(22) Filed: Oct. 21, 2010

(65) Prior Publication Data

US 2012/0099999 A1 Apr. 26, 2012

(51) Int. Cl.
*F04D 29/34* (2006.01)

(52) U.S. Cl.
USPC ..... 416/218; 416/222

(58) Field of Classification Search
USPC ..... 416/216, 217, 218, 222, 220 R
See application file for complete search history.

(56) References Cited

U.S. PATENT DOCUMENTS

| | | | | |
|---|---|---|---|---|
| 2,199,243 | A * | 4/1940 | Mortimer | 416/217 |
| 7,261,518 | B2 | 8/2007 | Golinkin et al. | |
| 2006/0216152 | A1* | 9/2006 | Golinkin et al. | 416/220 R |
| 2009/0047128 | A1 | 2/2009 | Bracken et al. | |

* cited by examiner

*Primary Examiner* — Dwayne J White
(74) *Attorney, Agent, or Firm* — Ernest G. Cusick; Frank A. Landgraff

(57) ABSTRACT

An arrangement and a method for mounting articulated turbine buckets in axial entry slots of rotor wheels. A curvature on a vertical plane may be incorporated on an axial male dovetail projection of the bucket root and the associated axial female dovetail slot of the rotor wheel. The curvature facilitates loading of buckets otherwise precluded by interferences, such as interlocking tip shrouds on adjacent buckets. Such loading may be provided by locating the shroud tip shroud in proximity to an adjacent tip shroud and pivoting the root end of the bucket around the location of the tip shroud such that the arc formed by the bucket allows the curvature of the axial male dovetail projection to swing into the axial female dovetail slot of the rotor wheel.

13 Claims, 10 Drawing Sheets

SWING AXIAL-ENTRY FOR CLOSURE BUCKET USED FOR TANGENTIAL ROW IN STEAM TURBINE

BACKGROUND OF THE INVENTION

The invention relates generally to turbomachines and more specifically to an arrangement and a method for mounting articulated turbine closure buckets in entry slots of rotor wheels of the turbomachines.

Rotors for turbomachines are often machined from large forgings. Rotor wheels cut from the forgings are often slotted to accept the roots of turbomachine buckets for mounting. As the demand for greater turbomachine output and more efficient turbomachine performance continues to increase, larger and more articulated turbomachine buckets are being placed into service. The loads exerted by the larger buckets have increasingly required that more sophisticated and expensive materials and alloys be used for the turbine buckets and rotor wheel.

Adjacent turbine buckets on a rotor wheel are typically connected together by some form of cover bands or shroud bands around the periphery to confine the working fluid within a well-defined path and to increase the rigidity of the buckets. The interlocking shrouds may often present interferences in assembling buckets on the rotor wheel.

Turbine buckets are often assembled onto the rotor wheel in a tangential direction. Tangential entry dovetail design requires an opening or notch around the periphery of the rotor wheel where the buckets are inserted radially and then slid tangentially into place. After the assembly of all regular buckets, the notch is filled with a closure bucket and two adjacent (auxiliary) buckets. The closure bucket is keyed to auxiliary buckets. Thus the two auxiliary buckets share the pull-load of closure bucket. Such closure bucket and auxiliary buckets and even the keys must often be fabricated from materials with higher strength properties to accommodate the load of the closure bucket. Higher strength-lightweight materials, such as titanium, that are used for the closure arrangements are more costly than the steel buckets conventionally used for the regular buckets. Also, when titanium is used for closure and auxiliary buckets, then balancing buckets also made of lightweight titanium are needed to balance the load over the rotor wheel.

FIG. 1 illustrates a prior art turbine closure arrangement 5 for a turbine wheel, including closure buckets 30 and auxiliary buckets 10 for tangential entry onto a rotor wheel. The auxiliary buckets 10 are mounted on a tangential male dovetail 20 of the rotor wheel 25 on each side of a closure slot 15. The closure bucket 30 is shown in position for mounting on the male dovetail 20 in the closure slot 15. Each auxiliary bucket 10 includes a vane 11 and a root 12 that includes a female dovetail complimentary (obscured) to the tangential male dovetail 20. The closure slot 15 includes notches 45 in the male dovetail 20 of the rotor wheel 25. The auxiliary buckets 10 and the remainder of buckets (not shown) are inserted over the notches 45 and then disposed tangentially around the periphery of the rotor wheel 25. The closure bucket 30 includes a vane 31 and a root 32 that includes tangs 33 arranged to ride over the notches 45 in the male dovetail 20 of the rotor wheel 25. The closure bucket 30 may also include axial holes 42 through the tangs 33 for locking to axial holes 43 of the male dovetails 20 of the rotor wheel 25 with retaining pins 46. The closure bucket 30 further includes semicircular slots 34 for accepting retaining keys 35. The closure bucket 30 may be lowered into the closure slot 15 and locked to the notches 45 with retaining pins 46. The closure bucket 30 may then be locked with auxiliary buckets 10. Such an arrangement may put undesirable stresses on the narrow notched portion 45 of the rotor wheel 25.

Accordingly, it would be desirable to provide a closure arrangement and method for use with the loading of tangential entry buckets onto rotor wheels for turbomachines that would avoid undesirable high stresses but yet could avoid the use of more-costly special materials.

BRIEF DESCRIPTION OF THE INVENTION

According to a first aspect of the present invention, a steam turbine is provided that includes at least one rotor wheel with a male tangential entry dovetail around a peripheral circumference and a swing axial-entry closure slot interrupting the male tangential entry dovetail. Tangential entry buckets populate the male tangential entry dovetail around the peripheral circumference of the rotor wheel. A swing axial-entry dovetail closure bucket is configured to seat in the swing axial-entry closure slot.

According to a second aspect of the present invention, a closure arrangement is provided for a rotor wheel of a steam turbine. The closure arrangement includes a tangential male dovetail providing multiple hooks and grooves formed over a peripheral portion of the rotor wheel. A closure slot is formed by removal of portions of the tangential male dovetail for entry of a swing axial-entry bladed closure bucket on the periphery of the rotor wheel. The closure slot provides an axial-oriented female dovetail including axial edges of hooks and grooves providing a radial curvature in the vertical plane. The swing-axial bladed closure bucket includes a root portion, a platform and a blade, wherein the root portion forms an axial-oriented male dovetail including circumferential edges providing a radial curvature in the vertical plane conformed to the radial curvature of the axial-oriented female dovetail.

A further aspect of the present invention provides a method for loading a tangential entry turbine wheel with bladed buckets including a swing-axial entry bladed closure bucket. The method includes tangentially loading a plurality of bladed buckets through a swing axial-entry closure slot around a periphery of the turbine wheel. The swing axial-entry bladed closure bucket is swing loaded at the swing axial-entry closure slot. The method further includes locking the swing-axial entry bladed closure bucket in the swing axial-entry closure slot.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including permitting the replacement of expensive titanium (Ti) closure buckets, auxiliary buckets, and balancing buckets with lost-cost steel material. A swing axial-entry closure dovetail arrangement is provided to a closure bucket for a tangential entry bucket row, allowing replacement of the titanium closure/auxiliary buckets with buckets utilizing a low cost steel material. These embodiments facilitate installation for closure buckets with interlocking tip shrouds onto rotor wheels. A curvature on a vertical plane may be incorporated on a swing axial-entry male dovetail projection of the bucket root and on the associated swing-axial female dovetail closure slot of the rotor wheel. The curvature facilitates installation of the closure buckets that otherwise might be precluded by interferences, such as interference of interlocking tip shrouds on adjacent buckets. Such installation may be provided by locating the shroud tip in proximity to adjacent tip shrouds and pivoting the root end of the bucket around the location of the tip shroud such that the arc formed by the bucket allows the curvature of the swing axial-entry male dovetail projection to swing into the axial-entry female dovetail slot of the rotor wheel, hence leading to the description of a swing-axial entry closure bucket. Stress concentrations at dovetail edges can also be reduced. Implementation of curvature on the dovetails need not restrict the tip shroud configuration or the mid-span configuration for bucket. Use of the inventive dovetail arrangement allows the design of the tip shrouds to not be limited by assembly constraints, thereby providing enhanced blade performance.

According to embodiments of the present invention, a dovetail curvature is provided in a vertical plane parallel to the dovetail for a swing axial-entry male dovetail projection of a swing axial-entry closure bucket and a swing axial-entry female dovetail slot in the rotor wheel. Such curvature is desirably employed for easing assembly of long, axial entry buckets. The dovetail is provided with a curvature in vertical plane such that the center of curvature lies near the tip shroud or cover of the bucket. The curvature would have a radius approximately equal to distance between dovetail and bucket tip (approximating the active length). The swing axial-entry dovetail slot is provided with a similar curvature, whose radius can be varied slightly such that location of initial contact between bucket and wheel crush surfaces can be controlled. The dovetail curvature is in a plane parallel to dovetail and includes a bucket radial line, thus helping to swing it easily during assembly with wheel.

Figure 1:
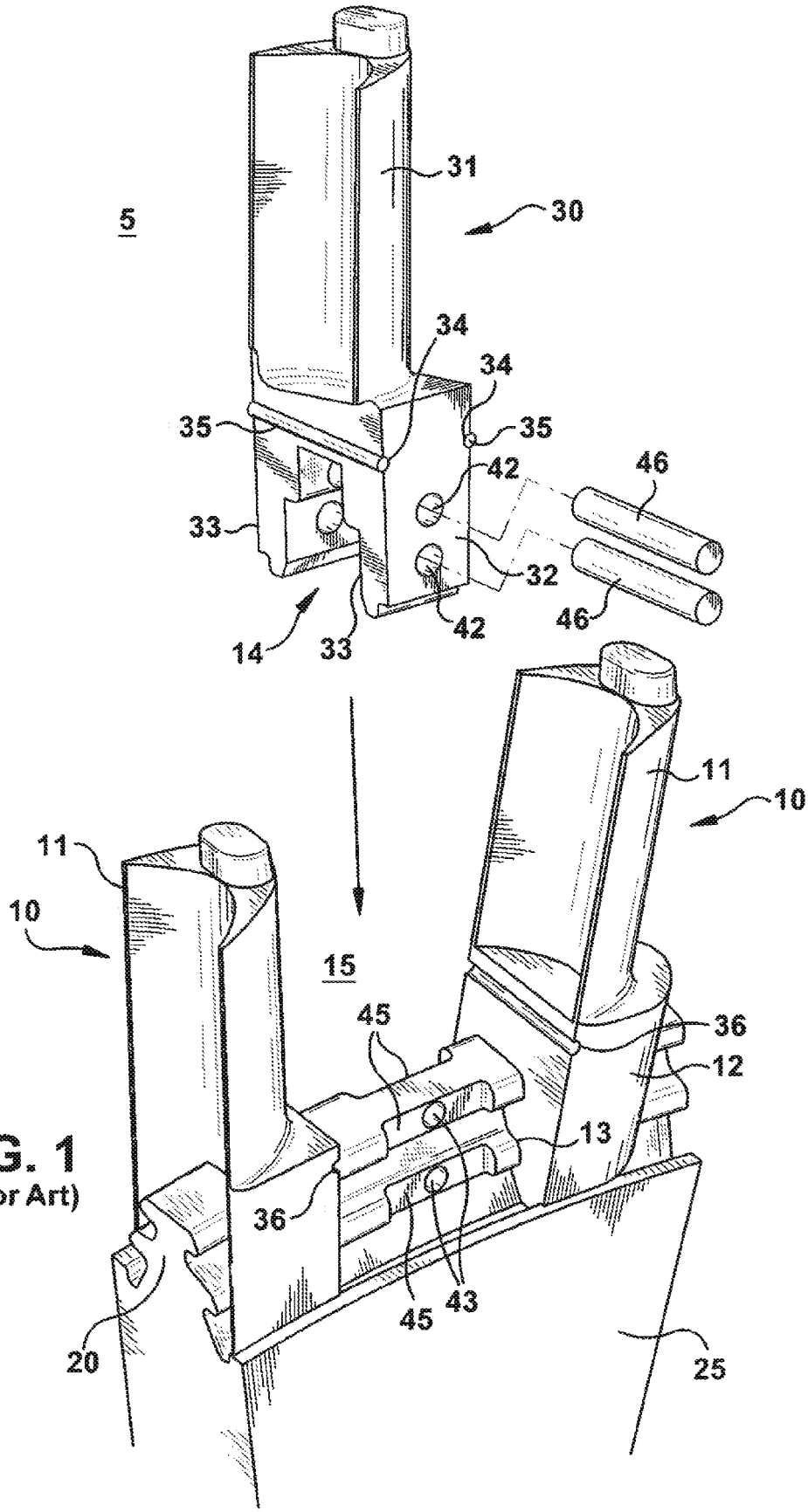
FIG. 1 (Prior Art)
FIG. 1 illustrates a prior art turbine closure bucket and auxiliary buckets for dovetailed tangential entry buckets of a rotor wheel.
Figure 2:
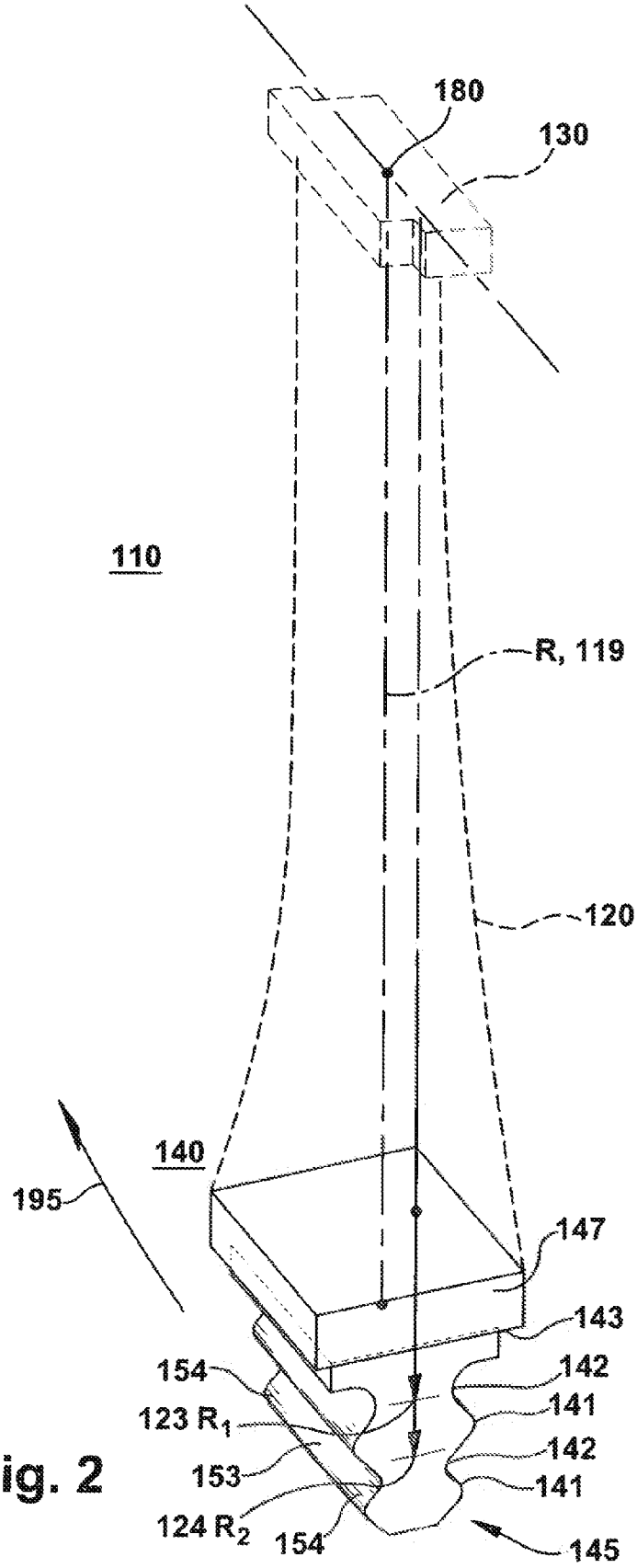
FIG. 2 illustrates a simplified representation for a radius of curvature for hooks and grooves of a swing axial-entry dovetail closure bucket.

FIG. 2 illustrates a simplified representation for a radius of curvature for hooks and grooves of an embodiment for a swing axial-entry closure dovetail bucket (also referred to as closure bucket). The swing axial-entry dovetail closure bucket 110 includes a vane 120 with a tip shroud 130 and a portion of a root 140. A male swing axial-entry dovetail projection 145 on a root 140 includes multiple hooks 141 with grooves 142 interspersed therebetween. The radius of curvature for the hooks 141 and grooves 142 extends approximately from the tip shroud 130 to the root 140. A seating ledge 143 is provided for support root 140, which will be described in greater detail below. The embodiment is illustrated with two hooks 141 and two grooves 142 below the seating ledge 143, however the number and size of the hooks and grooves are determined for the specific application of bucket mounting.

The individual hooks 141 and individual grooves 142 on an individual bucket dovetail projection 145 (and corresponding hooks and grooves of female dovetail slot 155 in rotor wheel 165 (FIG. 4) may be cut with a different radius of curvature R 119, dependent on the specific radial distance from at the center of curvature 180 as represented by radius $R_1$ 123 and radius $R_2$ 124. The center of curvature 180 may also function as a pivot point for swing loading 195 the closure bucket as will be described in greater detail.

By keeping the dovetail curvature radius 119 of the rotor wheel slightly less than bucket dovetail curvature, it can be ensured that initial contact between bucket and wheel dovetail would occur at center 153 of dovetail, and contact spreads to edges 154 as bucket load increase during turbine operation. With an appropriate curvature difference between bucket dovetail and the wheel dovetail, three-point contact can be achieved, where one point of contact is provided on a contact surface and two points of contract are provided on non-contact surfaces. Clearances between non-contact surfaces as well as contact surfaces may be designed to provide enough space to accommodate cover rotation over a small angle. Further, the wheel dovetail curvature can be optimized to modify stress distribution to the requirements for a specific application.

Figure 3:
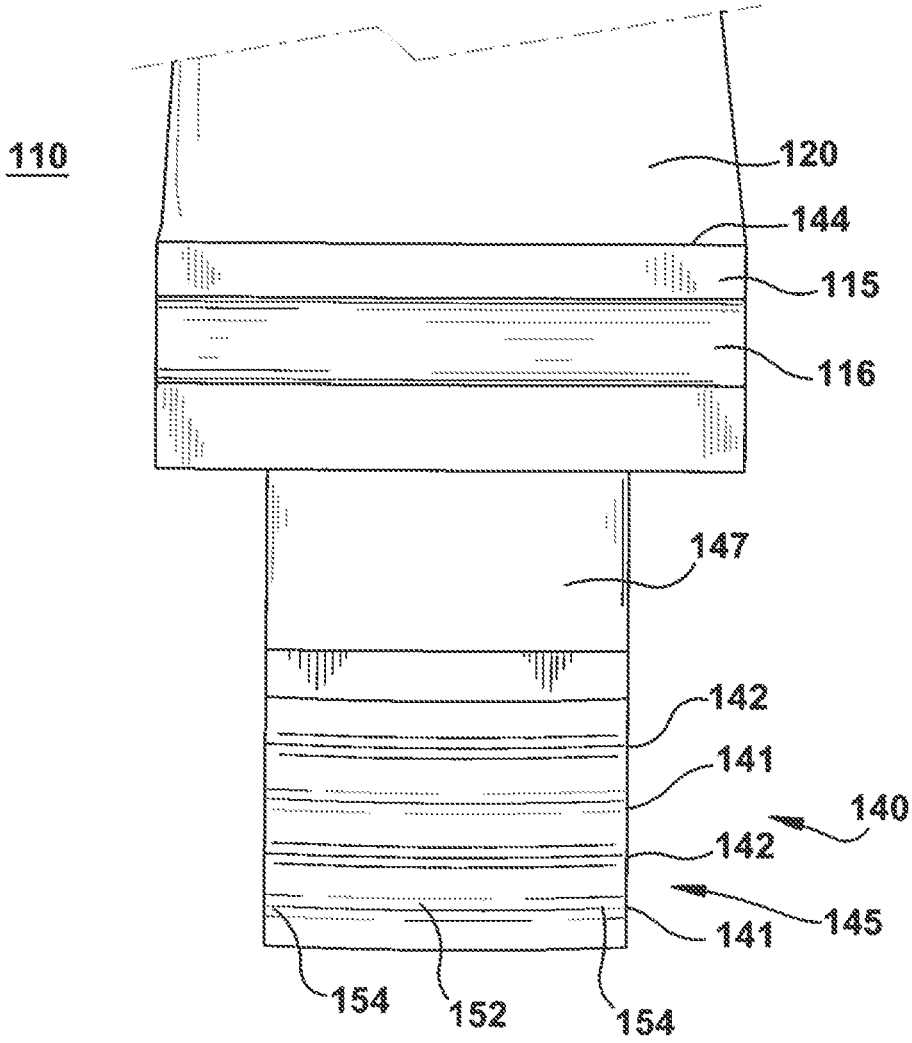
FIG. 3 illustrates an expanded axial view of root of an embodiment for the swing axial-entry dovetail closure bucket showing curvature of the hooks and the grooves.

FIG. 3 illustrates an expanded axial view of root 140 of an embodiment for the closure bucket 110 showing curvature of the hooks 141 and the grooves 142. One embodiment of the invention includes two hooks 141 and two grooves 142 below support root 147 of the platform 115, although other numbers and arrangements of hooks and grooves may be contemplated within the scope of the present invention. Semicircular retention pin slots 116 are formed on each tangential side of platform 115. The outer surfaces 144 of platforms 115 may form a continuous outer radial surface above the rotor wheel, when the buckets 110 are mounted to the rotor wheel 165 (FIG. 10).

Figure 4:
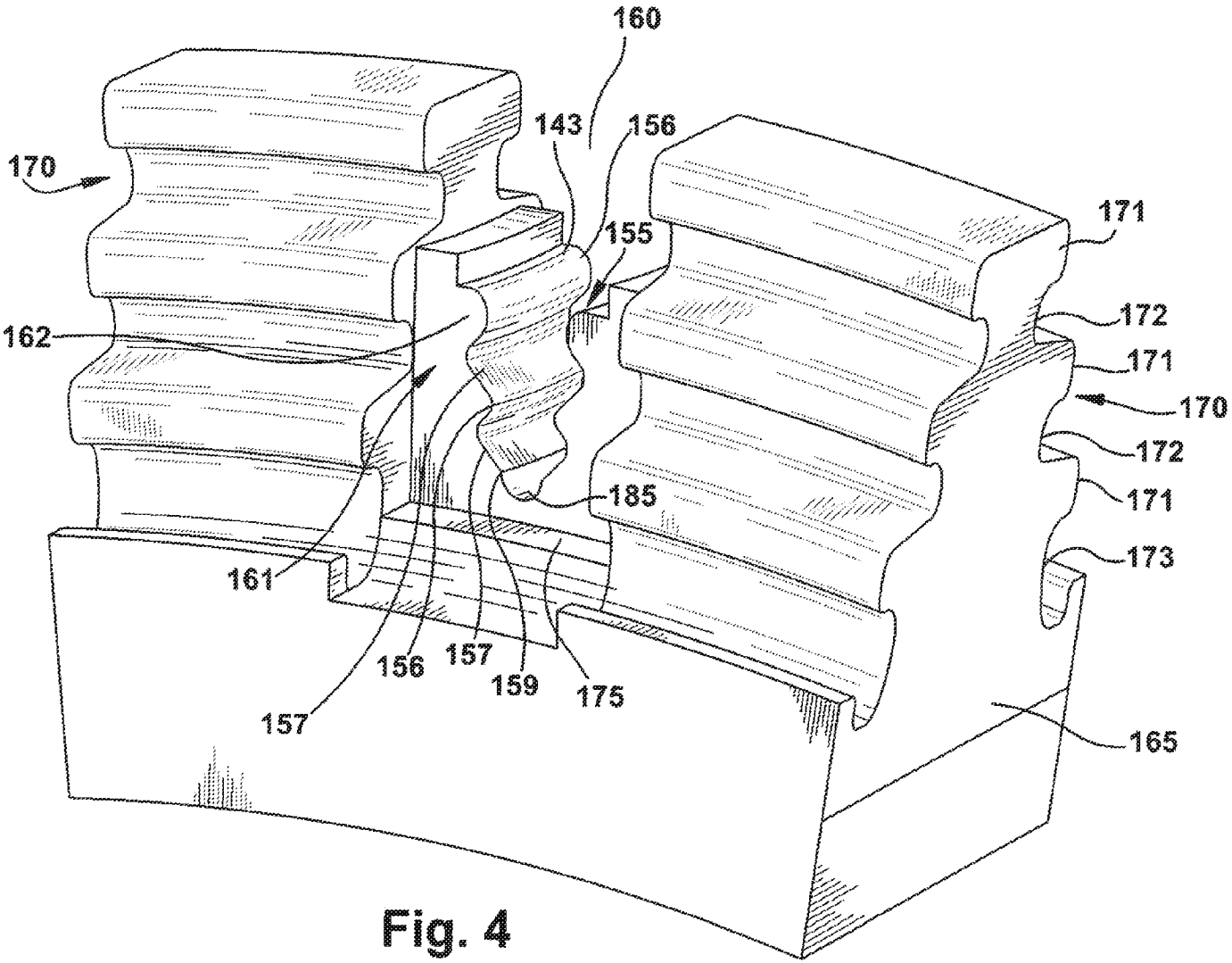
FIG. 4 illustrates a perspective view of a peripheral section of an embodiment for a rotor wheel with a swing axial-entry female dovetail slot within a closure slot and tangential male dovetail in the surrounding circumference.
Figure 5:
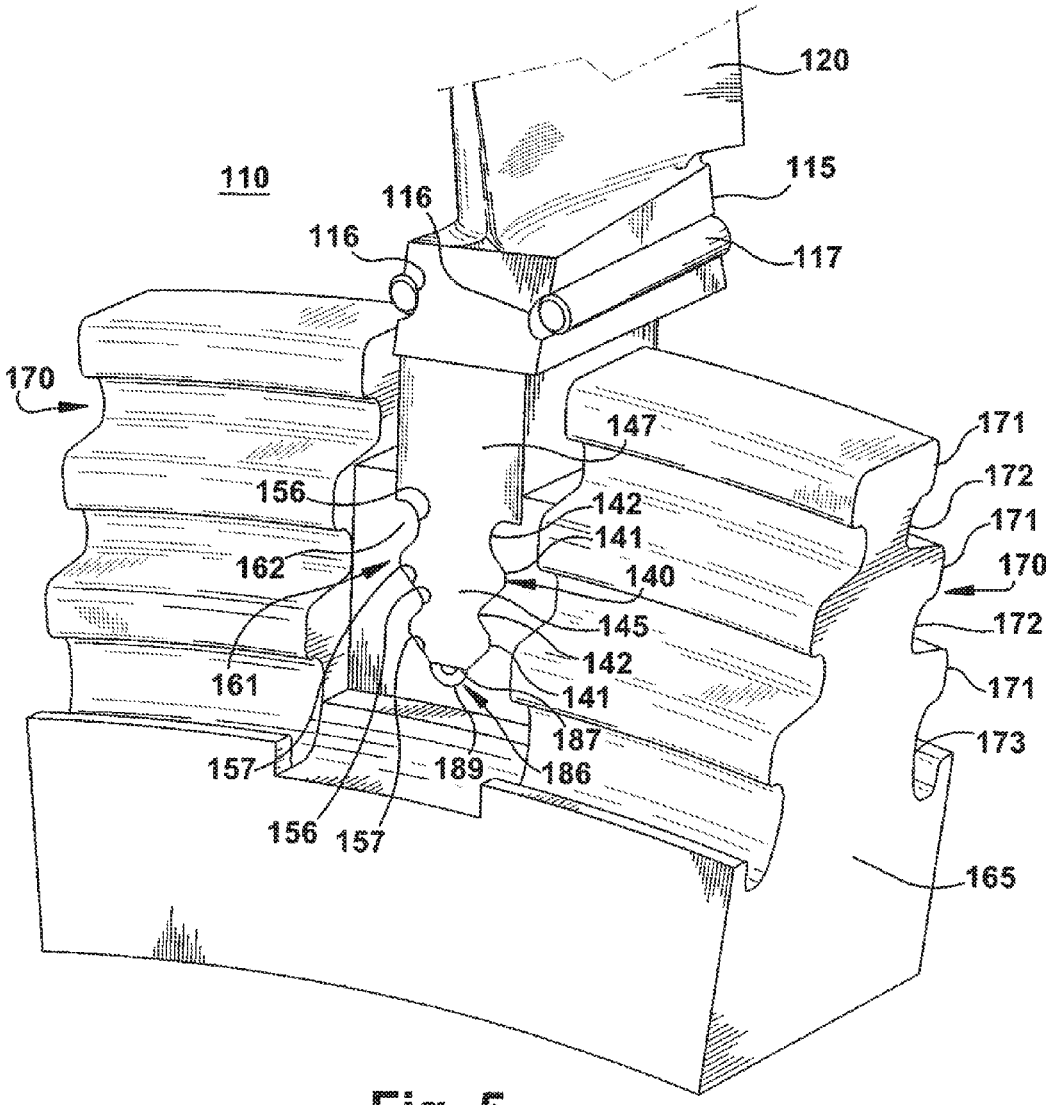
FIG. 5 illustrates a perspective front side view of an embodiment front side of a swing axial-entry dovetail closure bucket seated in the swing axial-entry female dovetail closure slot on a rotor wheel.
Figure 6:
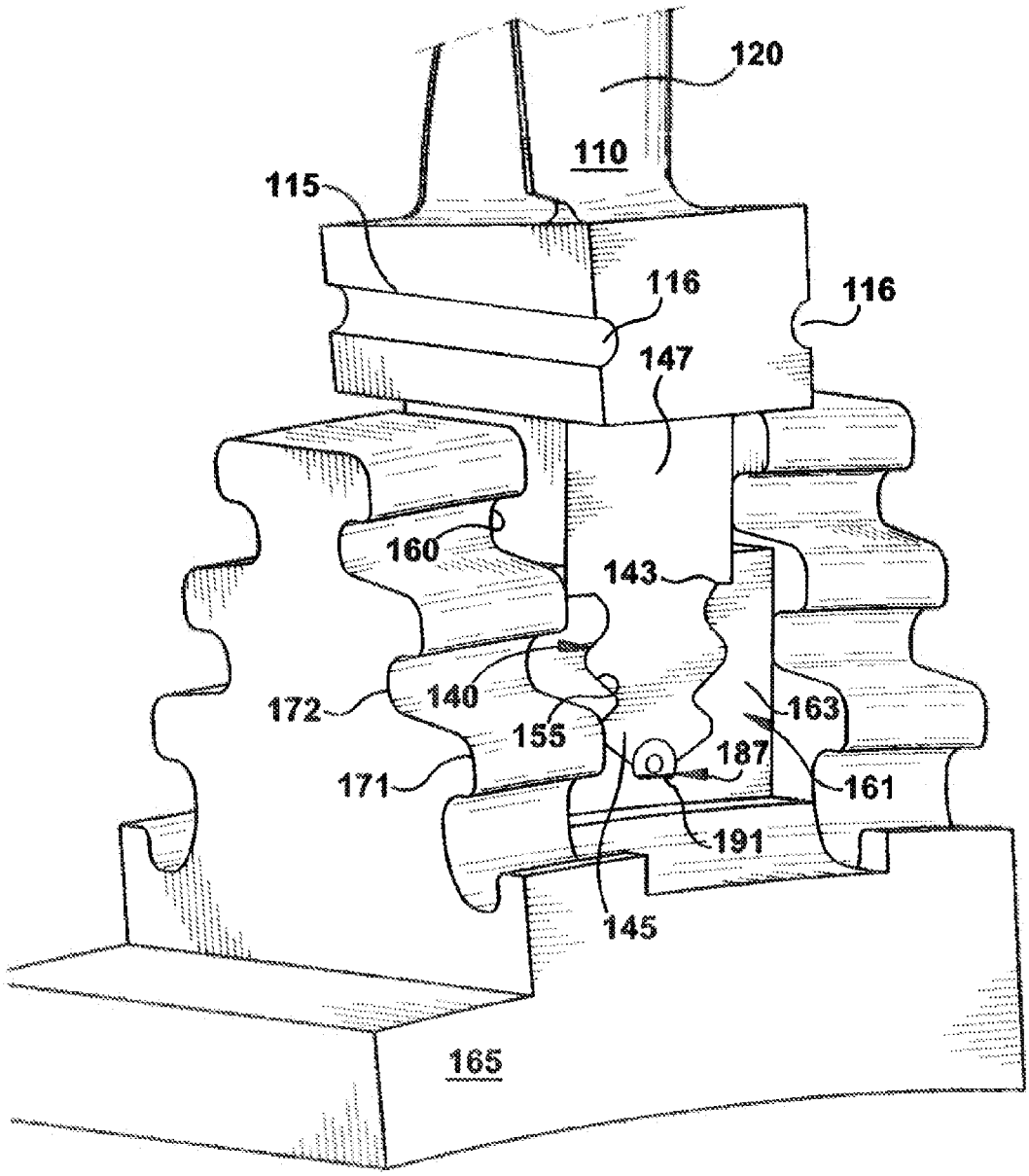
FIG. 6 illustrates a perspective view of a backside of an embodiment for a swing axial-entry closure bucket seated in the swing axial-entry female dovetail closure slot on the rotor wheel.

FIG. 4 illustrates a perspective view of a peripheral section of a rotor wheel with a swing axial-entry female dovetail slot within a closure slot and tangential male dovetail in the surrounding circumference. The peripheral section of a rotor wheel 165 includes a closure slot 160 for a swing axial-entry dovetail closure bucket 110 (FIG. 5) and a tangential male dovetail 170 for tangential entry dovetailed buckets (FIG. 10) in the surrounding circumference. The tangential male dovetail 170 includes multiple hooks 171 and grooves 172, 173 for engaging the tangential entry dovetailed buckets 325 (FIG. 10). The closure slot 160 includes a female swing axial-entry dovetail slot 155 within housing block 161 for radially retaining the swing axial-entry closure bucket 110 (FIG. 5). The female swing axial-entry dovetail slot 155 may be centered axially and tangentially in housing block 161 between tangential male dovetails 170 to each side of the closure slot 160. The housing block 161 includes a forward face 162 and a similar rear face (FIG. 6). The female swing axial-entry dovetail slot 155 may include multiple hooks 156 and grooves 157 on tangential sides, as well as, a bottom groove 159. Each tangential side 158 may further include a seating ledge 143. The hooks 156, the grooves 157, 159 and the seating ledge 143 of slot 155 includes a curvature in a vertical plane such that the center of curvature lies near the tip or cover 130 (FIG. 2) of the swing axial-entry bucket 110 (FIG. 5) to be inserted. The radius can be varied slightly such that the location of initial contact between crush surfaces for the swing axial-entry closure bucket 110 (FIG. 5) and hooks 156 and grooves 157, 159 of swing axial-entry dovetail slot 155 can be controlled. An axial slot 185 is cut at inner radial part of lower groove 159 of closure block 161. The axial slot extends from the forward face 162 to the rear face 163 (FIG. 6) of the closure block 161. The axial slot 185 may be used for installing a twist lock key (FIGS. 5 and 6) to axially secure the swing axial-entry dovetail 145 of bucket root 140 in the closure block 161.

FIG. 5 illustrates a perspective front-side view of a swing axial-entry dovetail closure bucket seated in the swing axial-entry female dovetail closure slot on a rotor wheel. The half-head 187 of twist lock device 186 is rotated to an inner radial orientation, which permits the dovetail projection 145 to be inserted within female swing axial-entry dovetail slot 155 (FIG. 4). The dovetail projection 145 of root 140 for swing axial-entry closure bucket 110 is shown fully seated within female swing axial-entry dovetail slot 155 of mounting block 161 of the closure slot 160 (FIG. 4). The support root 147, joins the dovetail projection 145 with a platform 115. The platform 115 supports vane 120. The platform 115 may further include axial recesses 116 for receiving radial retention pins 117 for engaging adjacent tangential dovetailed buckets (not shown). FIG. 6 will show the twist lock device rotated to a locking position for retaining dovetail projection 145.

Figure 9:
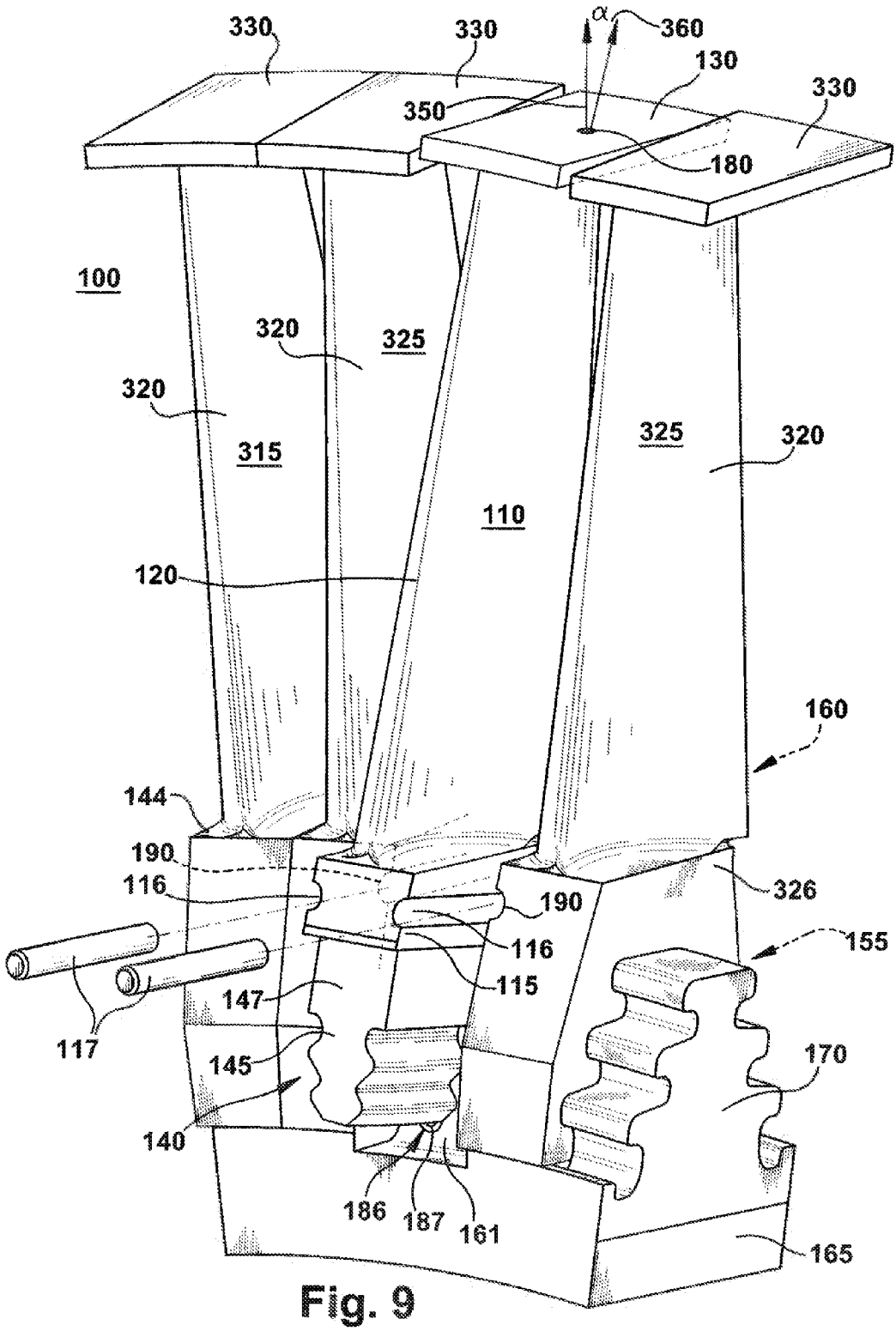
FIG. 9 illustrates an embodiment for a swing axial-entry dovetail closure bucket being installed between mounted tangential-entry auxiliary buckets.
Figure 10:
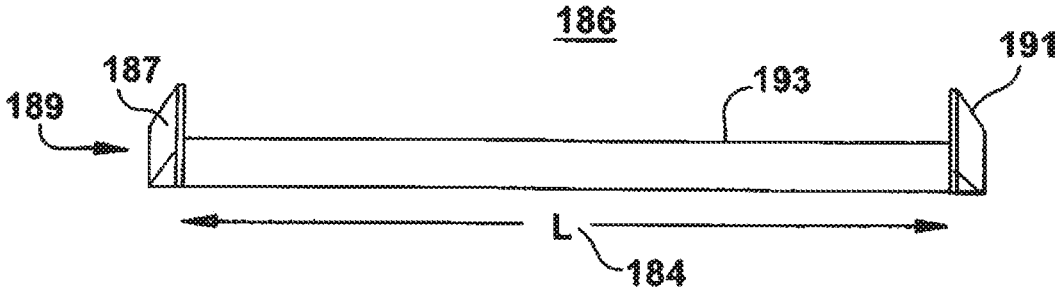
FIG. 10 illustrates a side view of a twist lock key adapted for holding the swing axial-entry dovetailed bucket in dovetailed slots.

FIG. 10 illustrates a side view of a twist lock key 186 adapted for holding the swing axial-entry dovetailed bucket in dovetailed slots. The twist lock key 186 includes a center pin 193 with heads at each end of the center pin. The front head 189 at a first end of the center pin 193 is formed as a half-head 187 and includes a staking tab. The rear head 191 at the second end of the center pin 193 is formed as a half-head with staking tab. A channel 185 in the closure block 161 of rotor wheel 165 (FIG. 4) is sized for the center pin 193. The length 194 of the center pin 193 is set to match the length of channel 185 (not shown) with the half-head 187 outside the front face 162 of the closure block 161 (FIG. 4) and rear half-head 191 of the center pin 193 outside the rear face 163 of the closure block 161. Before the swing axial-entry bucket 110 (FIG. 3) is installed, the twist lock key 186 is positioned such that the half heads 187, 191 are oriented in the inward radial direction (FIG. 9). The twist lock device 187 is then lowered into the channel 185 below the female swing axial-entry dovetail slot 155 to allow entry of the swing axial-entry dovetailed projection 140 of into the swing axial-entry dovetail slot 155. When the swing axial-entry dovetailed projection 140 is mounted within the dovetail slot 155, the half-heads 187, 191 of the of the twist-lock key 186 are rotated in an outward radial direction over a bottom portion of the dovetailed projection 140 to lock the dovetail projection 145 in place (FIG. 6).

FIG. 6 illustrates a perspective backside view of a swing axial-entry closure bucket 110 seated in the swing axial-entry female dovetail closure slot 155 on a rotor wheel 165. The dovetail projection 145 of root 140 for swing axial-entry closure bucket 110 is fully seated in female swing axial-entry dovetail closure slot 155 of mounting block 161 of the closure slot 160. The root 140 further includes the support root 147, above the dovetail projection 145 and joining the dovetail projection with a platform 115. The platform 115 supports vane 120. Both heads 187 and 191 of twist lock key 186 support the bucket 110 in place against axial motion.

Figure 7:
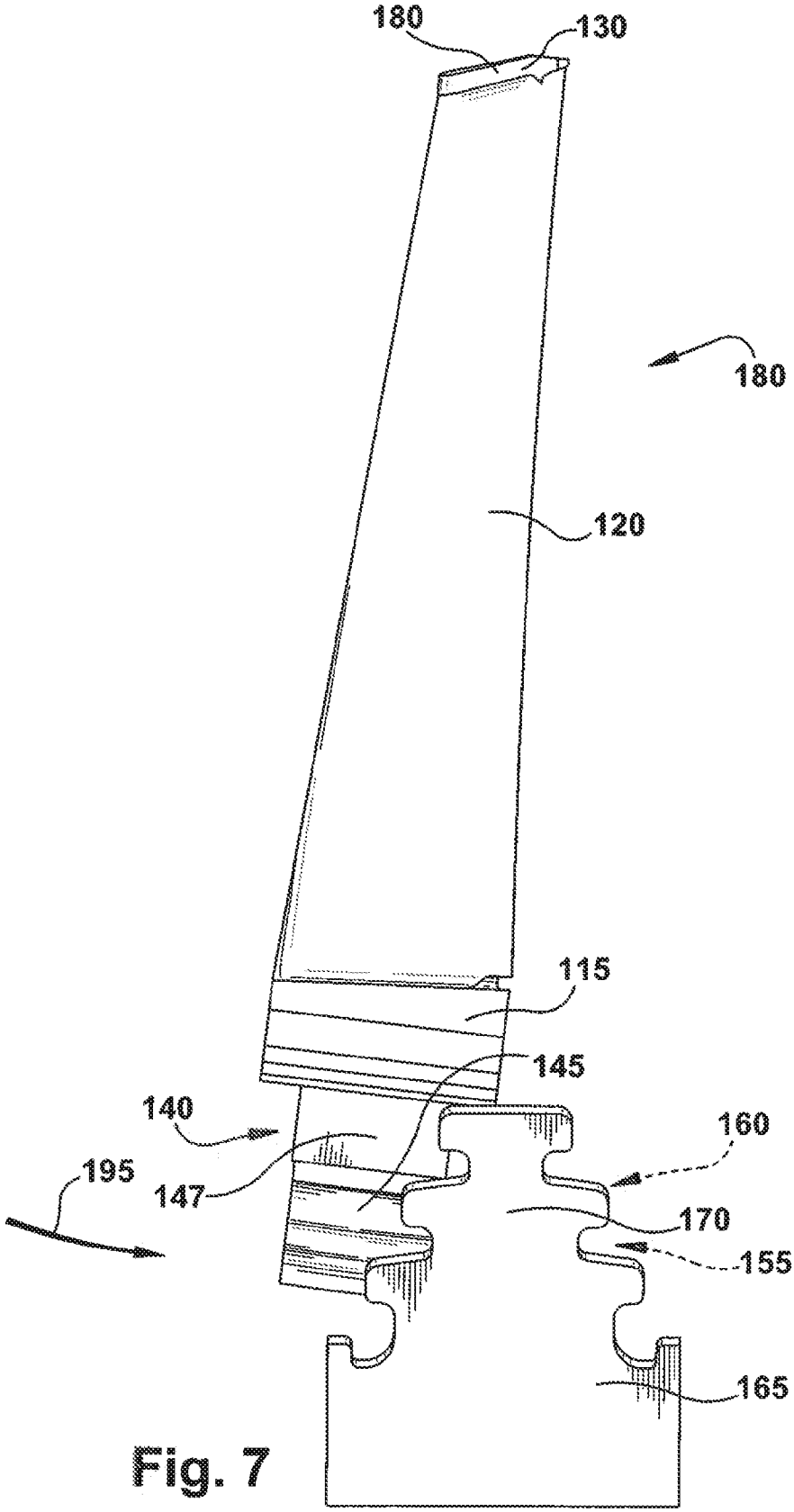
FIG. 7 illustrates a tangential view of an embodiment swing axial-entry dovetail closure bucket being installed on a rotor wheel.

FIG. 7 illustrates a side view for an installation of a swing axial-entry dovetail closure bucket 110 into a rotor wheel 165. The tip shroud 130 of the bucket 110 is positioned above the rotor wheel 165 with complimentary hooks and grooves to the bucket. The tip shroud 130 is located at a center of radius 180 such that with the bucket located in proximity to an entrance to female dovetail slot 155 of the rotor wheel 165. By maintaining the tip shroud 130 at the center of the radius 180, the bucket 110 may be swung through an arc 195 into engagement with the female dovetail slot 155. When other buckets (not shown) are already in place, the tip shroud 130 may be first oriented among the tip shrouds (not shown) for adjacent buckets.

Figure 8:
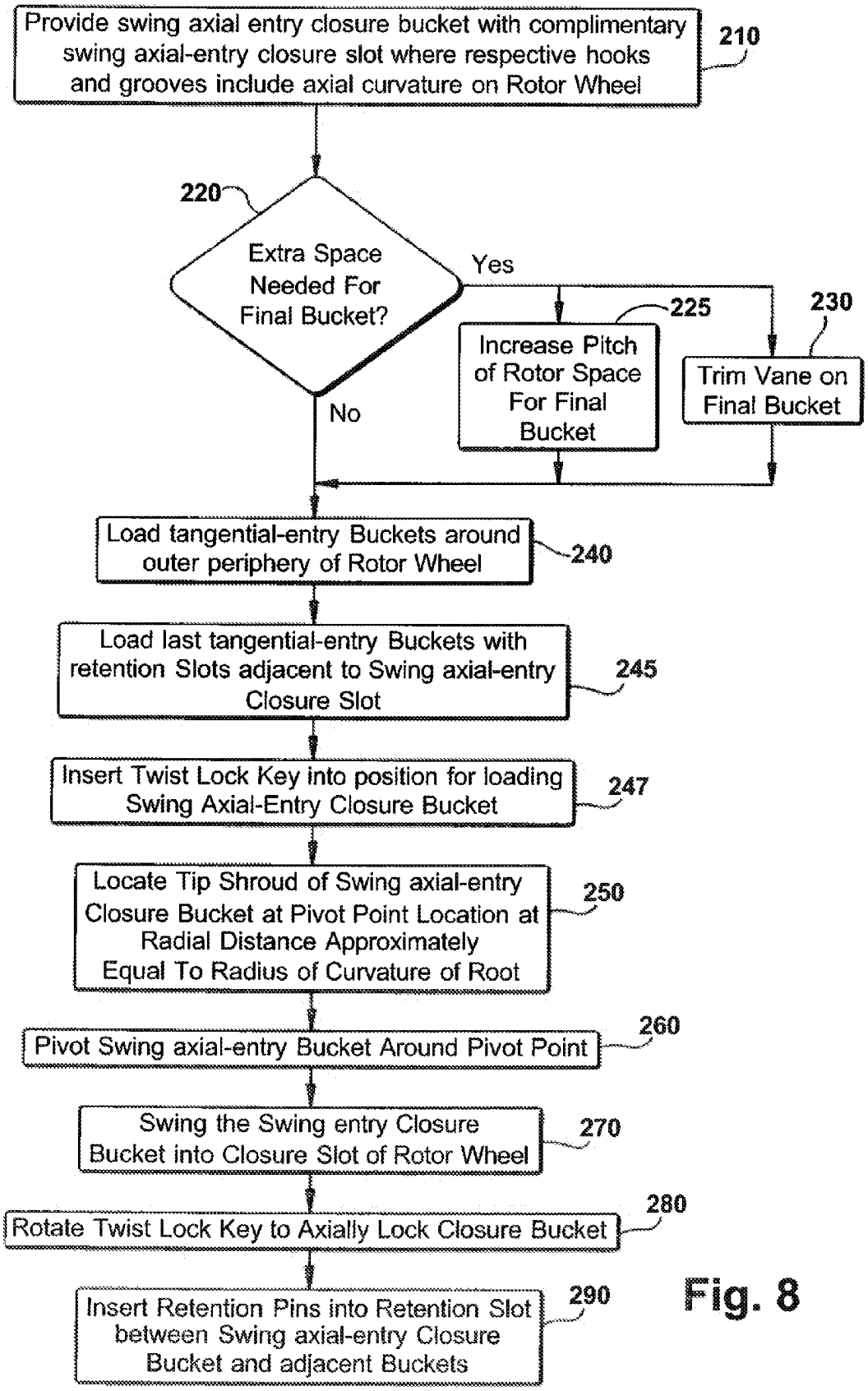
FIG. 8 illustrates a flowchart for a method of loading a rotor wheel including a swing axial-entry dovetail closure bucket.

A method is provided for assembling the swing axial-entry closure bucket onto the axial-entry dovetailed slots of the rotor wheel. The method avoids interferences of structural parts, such as articulated tip shrouds. The method may eliminate the need for equipment fixtures, heretofore required for mounting conventional axial-entry buckets. FIG. 8 illustrates a flowchart for the method of assembling the swing axial-entry closure buckets onto the swing axial-entry dovetailed slots of the rotor wheel. Step 210 provides a rotor wheel with a swing axial-entry closure slot including a curvature of hooks and grooves of the closure slot in a vertical plane, further including a tangential dovetail around the rotor wheel on each circumferential side of the closure slot. Step 220 provides a swing axial-entry closure bucket with a dovetail root corresponding to the swing-axial entry closure slot including a corresponding curvature in the vertical plane and a plurality of buckets with tangential entry roots. With appropriate curvatures between bucket and wheel dovetails, three point contact between bucket and wheel hooks can be achieved.

According to the specific application, Step 220 may provide a last bucket space on the rotor wheel with a larger pitch adapted to accommodate vane interferences. In Step 230, a blade for a last bucket to be assembled may be provided with a trimmed trailing edge to avoid interference.

Step 240 provides for mounting the plurality of buckets with tangential entry dovetailed roots around the periphery of the rotor wheel through the closure slot until only the last tangential entry bucket slots on each side of the closure slot remain open. Step 245 loads the last two tangential entry buckets with buckets that includes axial slots in the platform for inserting retention pins. Step 247 inserts a twist lock key into the twist lock key slot of the closure block. Step 250 locates a swing axial-entry closure bucket in a position such that a tip shroud is located in proximity to its final mounted position at a pivot point that is radially outward from curved surfaces hooks and grooves of the bucket root and spaced apart at a distance approximately equal to the radius of curvature. Step 260 provides for pivoting the swing axial-entry closure bucket at a pivot point at the tip shroud. In step 270, the dovetail of the swing axial-entry closure bucket is rotated around the pivot point to insert the axial-entry dovetail projection into an axial-entry closure slot. Steps 280,290 lock the swing axial-entry closure bucket in place. In step 280, the twist lock key is rotated so the half-head blocks axial motion of the bucket in the closure slot. In step 290, axial retention pins are inserted into axial recesses between the swing axial-entry closure bucket and the adjacent tangential entry buckets. Because the tip shrouds for the assembly of the succeeding buckets are initially located at essentially at their final mounted position and only experience a small rotational angle while the swing axial-entry dovetail is mated with the slot in the rotor wheel, the interference with adjacent tip shrouds may be avoided.

FIG. 9 illustrates a steam turbine 100 with a swing axial-entry closure bucket 110 being installed in a complimentary swing axial-entry dovetail closure slot 155 of closure slot 160 on a rotor wheel 165 between previously installed tangential-entry buckets 315. The tip shroud 130 of the swing axial-entry closure bucket 110 is located in proximity to the tip shrouds 330 atop vanes 320 of the adjacent buckets 315 as the bucket 110 is disposed at a swing angle α 360 to the radial direction 350. The hooks 141 and grooves 142 (FIG. 3) of the swing axial-entry closure bucket 110 and the hooks 156 and grooves 157 (FIG. 4) of the swing axial-entry closure slot 155 may be cut to a radius approximating the active length of the bucket. The dovetail projection 145 of the swing axial-entry closure bucket 110 may be rotated into place within closure slot 155 as the tip shroud 130 is maintained in place. Twist lock key 186 is installed in axial slot 185 of closure block 161 with half head 187 rotated inward radially to permit dovetail projection 145 of bucket 110 to slide over the twist lock key while the bucket seats. Radial retention pins 117 are inserted into place between slot 116 of platform 115 of bucket 110 and slot 190 of platform 326 of buckets 325 once the bucket is mounted.

While various embodiments are described herein, it will be appreciated from the specification that various combinations of elements, variations or improvements therein may be made, and are within the scope of the invention.

The invention claimed is:

1. A steam turbine comprising:

at least one rotor wheel comprising a male tangential entry dovetail around a peripheral circumference further including a swing axial-entry closure slot interrupting the female tangential entry dovetail around the peripheral circumference;

a plurality of tangential entry buckets populating the male tangential entry dovetail around the peripheral circumference of the rotor wheel; and a swing axial-entry dovetail closure bucket configured to seat in the swing axial-entry closure slot; wherein:

the swing-axial entry bladed closure bucket comprising:

a blade including a tip shroud;

a platform; and a root fitted to the closure slot for the rotor wheel, the root comprising a swing axial-entry male dovetail including a plurality of hooks and grooves providing a radial curvature in a vertical plane and the swing-axial entry dovetail closure bucket includes a radius of curvature for the plurality of hooks and grooves in the vertical plane comprising a length corresponding approximately to the active length of the blade.

2. The steam turbine according to claim 1, wherein the swing-axial entry closure slot includes a plurality of hooks and grooves complimentary to the hooks and grooves of the swing axial-entry closure bucket.

3. The steam turbine according to claim 1, wherein the root of the swing axial-entry closure bucket comprises an extended root portion on an upstream side of the root adapted for providing axial support to the swing-axial entry dovetail closure bucket in the closure slot.

4. The steam turbine according to claim 3, wherein a downstream side of the extended root portion is configured to engage with an upstream face of swing axial-entry dovetail closure slot of the rotor wheel for axial support.

5. The steam turbine arrangement according to claim 1, further comprising a locking arrangement including axial-oriented retention pins installed in locking cavities between the swing axial-entry dovetail closure bucket and adjacent tangential entry buckets.

6. A closure arrangement for a rotor wheel of a steam turbine comprising:

a tangential male dovetail including a plurality of hooks and grooves formed over a peripheral portion of the rotor wheel;

a closure slot formed by removal of portions of the tangential male dovetail for entry of a swing axial-entry bladed closure bucket on the periphery of the rotor wheel, wherein the closure slot comprises an axial-oriented female dovetail including axial edges of hooks and grooves providing a radial curvature in the vertical plane; and the swing-axial bladed closure bucket including a root portion, a platform and a blade, wherein the root portion includes an axial-oriented male dovetail including circumferential edges providing a radial curvature in the vertical plane conformed to the radial curvature of the axial-oriented female dovetail; wherein:

the swing-axial entry bladed closure bucket comprising:

the blade including a tip shroud; and a root fitted to the closure slot for the rotor wheel, the root comprising a swing axial-entry male dovetail including a plurality of hooks and grooves providing a radial curvature in a vertical plane and the swing-axial entry dovetail closure bucket includes a radius of curvature for the plurality of hooks and grooves in the vertical plane comprising a length corresponding approximately to the active length of the blade.

7. The closure arrangement according to claim 6 comprising:

a plurality of tangential entry buckets loaded on the tangential make dovetail including two tangential entry buckets adjacent to the swing axial-entry closure slot, wherein the adjacent buckets include a cavity for a retention pin disposed on a platform face adjacent to the swing axial-entry closure slot.

8. The closure arrangement according to claim 6, wherein the the extended root engaging a face of the swing axial-entry closure slot to provide axial support for the bucket.

9. The closure arrangement according to claim 6, wherein three point contact is between the hooks of the swing axial-entry dovetail bucket and the swing axial-entry closure slot.

10. A method for loading a tangential entry turbine wheel with bladed buckets including a swing-axial entry bladed closure bucket, the method comprising:

tangentially loading a plurality of bladed buckets through a swing axial-entry closure slot around a periphery of the turbine wheel;

swing axially loading a swing axial-entry bladed closure bucket at the swing axial-entry closure slot; and locking the swing-axial entry bladed closure bucket in the swing axial-entry closure slot; and wherein the step of tangentially loading comprises:

tangentially loading the plurality of bladed buckets until one bucket space remains on each tangential side of the swing axial-entry closure slot; and tangentially loading one bladed bucket on each adjacent side of the swing axial-entry closure slot wherein the adjacent bladed bucket includes a cavity for a retention pin on a face adjacent to the swing axial-entry closure slot.

11. The method according to claim 10, the step of swing-axial loading a swing-axial entry bladed closure bucket comprising:

positioning a tip shroud of a blade for the swing-axial entry bladed closure bucket in proximity to the mounted position for the tip shroud;

displacing a root of the swing axial-entry dovetail closure bucket rotationally from its mounted position by a sufficient angle for the root to be clear of the closure slot;

maintaining the tip shroud of the blade in position while pivoting the root in an arc coincident with the curvature of the hooks and grooves of the female dovetail in the closure slot; and rotating the hooks and grooves of the male dovetail for the swing axial-entry dovetail closure bucket into place within the hooks and grooves of the swing axial-entry female dovetail within the closure slot.

12. The method according to claim 11, the step of locking the swing-axial entry bladed closure bucket in the closure slot comprising:

inserting retention keys in the axial slots between adjacent tangential faces of the swing-axial entry bladed closure bucket and the auxiliary buckets when the swing axial-entry bucket has been loaded.

13. The method according to claim 12, the step of locking the swing-axial entry bladed closure bucket in the closure slot comprising:

inserting a twist lock device in a groove between a base of the swing axial-entry dovetail closure slot and the rotor wheel before the swing axial-entry bucket has been loaded; and rotating a twist lock head of the twist lock device to capture the root of the swing axial-entry bladed closure bucket in the closure slot after loading.

* * * * *